US006908320B2

(12) United States Patent
Genduso et al.

(10) Patent No.: US 6,908,320 B2
(45) Date of Patent: Jun. 21, 2005

(54) CONNECTOR ASSEMBLY FOR ATTACHING PERPENDICULARLY TO AN ADAPTER CARD

(75) Inventors: Thomas Basilio Genduso, Apex, NC (US); Douglas Michael Pase, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 122 days.

(21) Appl. No.: 10/008,965

(22) Filed: Nov. 13, 2001

(65) Prior Publication Data

US 2003/0092298 A1 May 15, 2003

(51) Int. Cl.[7] ..... H01R 13/44; H01R 13/15; H01R 13/62

(52) U.S. Cl. ..... 439/138; 439/265

(58) Field of Search ..... 439/138, 139, 439/140, 141, 143, 265, 352, 358

(56) References Cited

U.S. PATENT DOCUMENTS

| | | | | |
|---|---|---|---|---|
| 3,829,814 A | * | 8/1974 | Straus | 439/101 |
| 4,217,019 A | | 8/1980 | Cameron | |
| 4,493,517 A | | 1/1985 | Hillary | |
| 4,514,024 A | | 4/1985 | Clark | |
| 4,705,485 A | * | 11/1987 | Hansen | 439/669 |
| 5,082,453 A | | 1/1992 | Stutz, Jr. | |
| 5,154,629 A | | 10/1992 | Carver et al. | |
| 5,167,516 A | | 12/1992 | Tan et al. | |
| 5,376,206 A | * | 12/1994 | Maurer et al. | 156/242 |
| 5,409,403 A | * | 4/1995 | Falossi et al. | 439/668 |
| 5,475,317 A | * | 12/1995 | Smith | 324/760 |
| 5,564,934 A | | 10/1996 | Shimotsu | |
| 5,635,846 A | * | 6/1997 | Beaman et al. | 324/754 |
| 5,716,224 A | | 2/1998 | Masuda et al. | |
| 5,820,416 A | * | 10/1998 | Carmichael | 439/668 |
| 5,951,316 A | | 9/1999 | Kawano et al. | |
| 6,439,932 B1 | * | 8/2002 | Ripolone | 439/668 |
| 2002/0123256 A1 | * | 9/2002 | Brickett | 439/140 |

FOREIGN PATENT DOCUMENTS

GB 2209888 A 5/1989

* cited by examiner

*Primary Examiner*—Chandrika Prasad
(74) *Attorney, Agent, or Firm*—Joseph P. Lally; Martin J. McKinley

(57) ABSTRACT

A connection assembly comprising a receptacle portion and a probe portion. The receptacle portion is suitable for attaching to an adapter card. The receptacle may include a cylindrical housing with a longitudinal axis oriented perpendicular to the plane of the card. The receptacle includes a set of contact structures that extend within the interior of the receptacle housing. The set of contact structures are embedded within an electrically insulating contact block and preferably define one or more lines of contact structures extending perpendicularly to the plane of the adapter card. Each contact structure is electrically connected to a corresponding cable or wire. The probe portion may include a probe cover and a probe body configured to be received within the probe cover. The probe cover preferably comprises first and second elements that are separated by a gap that extends parallel to the longitudinal axis of the receptacle. The probe body includes a row of contact elements where each contact element is connected to a corresponding wire or cable. The probe body is preferably rotatable 90° with respect to the probe cover when the probe assembly is inserted in the receptacle. The probe body may be rotatable from a first position, in which the contact elements are covered by the probe cover, to a second position, in which the contact elements are aligned with the probe cover gap(s) and further aligned with corresponding contact structures on the interior surface of the receptacle.

30 Claims, 4 Drawing Sheets

CONNECTOR ASSEMBLY FOR ATTACHING PERPENDICULARLY TO AN ADAPTER CARD

BACKGROUND

1. Field of the Present Invention

The present invention generally relates to the field of connection devices and more particularly to an interconnection assembly having contacts oriented in a z-axis to minimize the assembly footprint in an x-y plane.

2. History of Related Art

Data processing systems such as desktop computers and server devices typically include one or more printed circuit boards (also referred to as adapter cards) that connect to the computer's mother board via a peripheral bus. These adapter cards expand the capability of the data processing system by providing dedicated hardware and code to off load various I/O tasks from the main processor(s). The Peripheral Component Interface (PCI), as specified in PCI Local Bus Specification Rev. 2.2 (PCI Special Interest Group, is a widely implemented example of such a peripheral bus).

PCI adapter cards are becoming increasingly more sophisticated and powerful. Whereas traditional PCI cards tended to support a single function and a single external interface, an increasing number of today's adapter cards are capable of supporting multiple interfaces. Some Small Computer System Interface (SCSI) adapters, for example, can support four SCSI channels and therefore must have 4 SCSI external connectors on the adapter. As PCI adapters continue to increase in performance and functionality, the amount of space the external connections require is becoming a significant limitation such that the number of connections an adapter card can support may not be limited by the adapter's performance capability. Instead, the limiting factor may be the amount of area that is available to attach external connectors to an adapter card. This problem will be most acute where the type of interface being supported by the adapter is a high pin count interface such as SCSI. In addition, the physical connection and locking mechanism necessary to attach the connector to the card. such that the connection will be secure during operation becomes more difficult in high pin count adapters. It would be highly desirable, therefore, to implement an interconnection assemble that accommodates high pin count connections while addressing the spatial constraints commonly encountered. It would further desirable if the implemented solution did not significantly increase the cost or complexity of the interconnection assembly.

SUMMARY OF THE INVENTION

The problems identified above are in large part addressed by a connection assembly suitable comprising a receptacle portion and a probe portion and an adapter card and data processing system in which the assembly is typically employed. The receptacle portion is suitable for attaching to an adapter card. The receptacle may include a cylindrical housing with a longitudinal axis that is perpendicular to the plane of the adapter card when the receptacle is attached. The receptacle includes a set of contact structures that extend within the interior space defined by the receptacle housing. The set of contact structures are preferably oriented along the longitudinal axis of the housing such that the they define one or more lines of contact structures extending perpendicularly to the plane of the adapter card. Each contact structure is electrically connected to a corresponding cable or wire that carries an electrical signal. The contact structures are embedded within an electrically insulating contact block. The connection assembly probe portion may include a probe cover and a probe body configured to be received within the probe cover. The probe cover preferably comprises first and second elements that are separated by a gap that extends parallel to the longitudinal axis of the receptacle when the probe is inserted. The probe body includes a row of contact elements where each contact element is connected to a corresponding wire or cable that extends through an interior of the probe body. The probe assembly is preferably configured wherein the probe body is rotatable 90° with respect to the probe cover when the probe assembly is inserted in the receptacle. In one embodiment, the probe body is rotatable from a first position, in which the contact elements are covered by the probe cover, to a second position, in which the contact elements are aligned with the probe cover gap(s) and further aligned with corresponding contact structures on the interior surface of the receptacle. The connection assembly may employ a locking mechanism such as a BNC-type locking mechanism to secure the probe within the receptacle.

BRIEF DESCRIPTION OF THE DRAWINGS

Other objects and advantages of the invention will become apparent upon reading the following detailed description and upon reference to the accompanying drawings in which.

Figure 1:
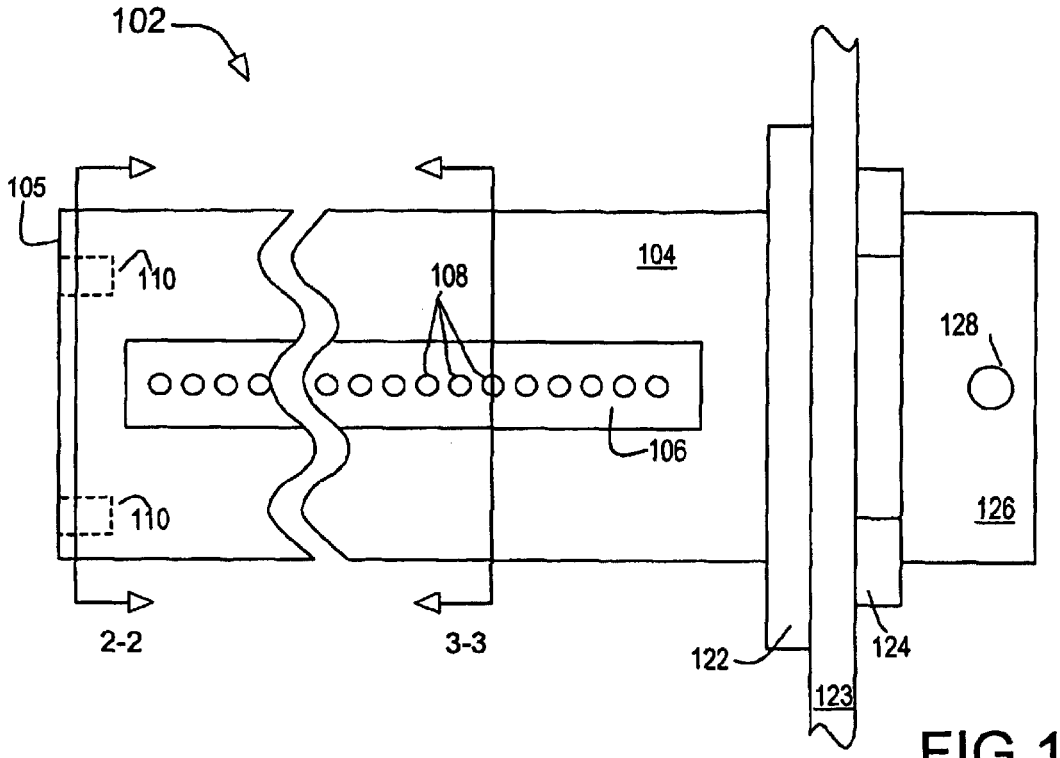
FIG. 1 is a plan view of a probe receptacle portion of a connection assembly according to one embodiment of the present invention.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF THE INVENTION

Figure 11:
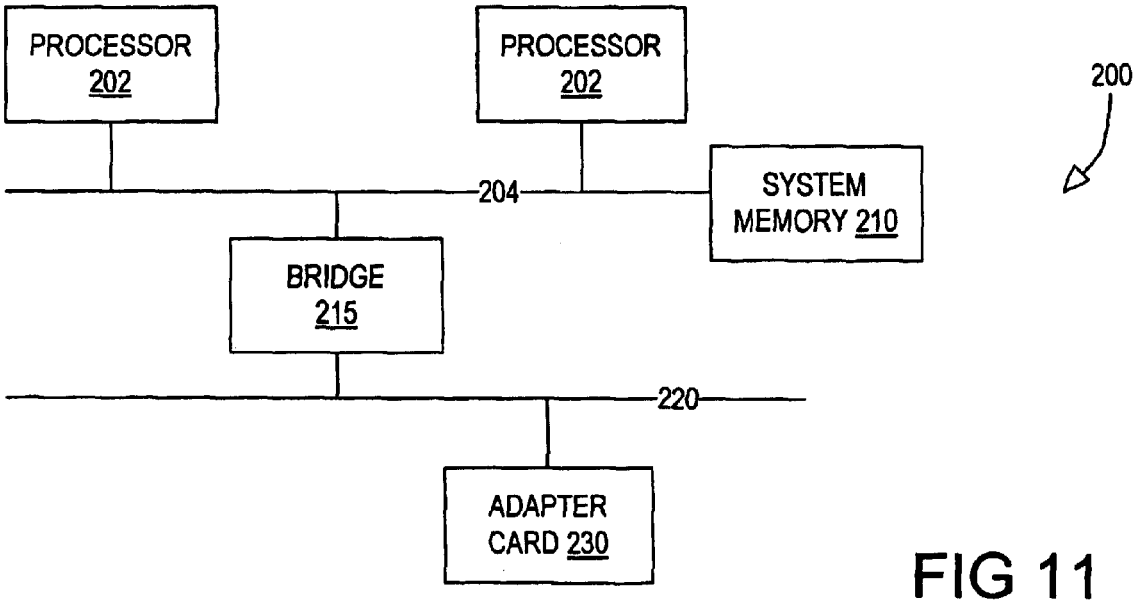
FIG. 11 is a diagram of selected elements of a data processing system enabled for use with the assembly depicted in FIGS. 1–10.

Generally speaking, the present invention contemplates an assembly that enables the interconnection of a large number of signals within a small "footprint." The assembly is suitable for use with a data processing system 200 (as shown in FIG. 11) that includes at least one processor 202, memory 210, input means, and an adapter card 123 all connected through one or more busses such as system bus 204 and peripheral bus 220. The assembly typically includes a receptacle 102 (described further below) that is configured to attach to adapter card 123 such as a PCI adapter card such that a longitudinal axis of the receptacle housing is perpendicular to adapter card 123. The receptacle includes a set of contact structures that extend along the housing longitudinal axis perpendicularly to the adapter card (i.e., along a z-axis) when receptacle 102 is attached to adapter card 123. Receptacle 102 is configured to receive a probe that is typically incorporated into a cable that would connect to adapter card 123. The contact areas of the probe are also oriented perpendicularly to the adapter to minimize the footprint of the receptacle/probe assembly on adapter card 123. By orienting the contacts along an axis perpendicular to the adapter card, the area of the adapter card required for the connector is substantially independent of the number of connections required. Moreover, by incorporating an appropriate locking mechanism, the assembly facilitates the secure connection of a large number of signals.

Turning now to the drawings, FIG. 1 is a top plan view of a probe receptacle 102 of an assembly for interconnecting electronic components according to one embodiment of the invention. As depicted in FIG. 1, receptacle 102 includes housing 104 typically comprised of an electrically and thermally conductive material such as aluminum. Housing 104 may be connected to ground during operating to provide an effective ground shield for the signals accommodated by the assembly. Housing 104 is typically configured to receive a probe element of the assembly (as discussed in greater detail below). To facilitate an embodiment in which it is desirable to rotate the probe when it is received within housing 104, housing 104 may implemented as a cylindrical housing and may include a first face 105 at a distal end of the cylindrical housing.

A rectangular contact block 106 is embedded in housing 104. Contact block 106 defines a set of apertures or holes suitable for receiving conductive cables or wires 108 that are used to provide electrical signals. Contact block 106 is typically comprised of an electrical insulator such as glass filled polyester, galvanized rubber, or another other suitable material.

Figure 2:
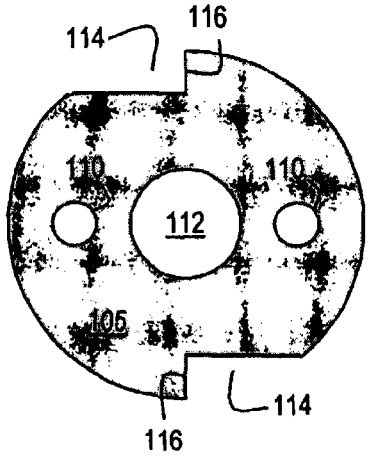
FIG. 2 is a cross sectional view of the probe receptacle of FIG. 1 taken along section 2—2.

Referring also to FIG. 2, a cross-sectional view of receptacle 102 taken along cross section 2—2 of FIG. 1 is illustrated. As depicted in FIG. 2, first face 105 of housing 104 includes a pair of guide pins 110 and a guide hole 112. Guide pins 110 are positioned and dimensioned to engage corresponding holes in a base plate of the probe while hole 112 is positioned and dimensioned to receive a shaft of the probe body when the probe is inserted in receptacle 102. First face 105 of housing 104 is further depicted as including a pair of notched elements 114. Notched elements 114 each define a face 116 that engages an opposing face in a notched element of the probe cover plate to provide a stopping mechanism that limits the amount of rotation of the probe cover within the receptacle.

Figure 3:
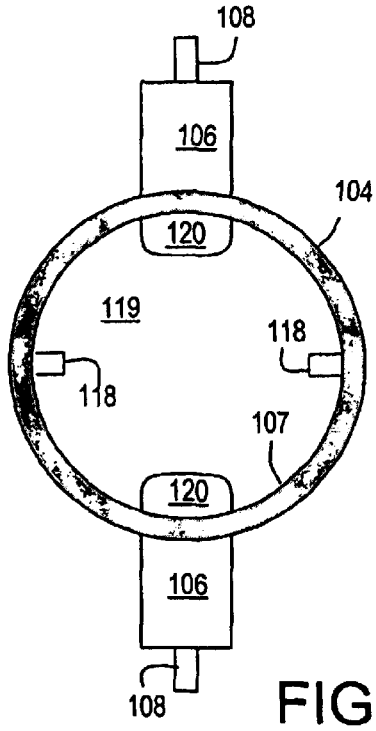
FIG. 3 is a cross sectional view of the probe receptacle of FIG. 1 taken along section 3—3.

Referring also now to FIG. 3, a cross sectional view of receptacle 102 taken along cross section 3—3 of FIG. 1 is illustrated. As depicted in FIG. 3, housing 104 defines an annular ring that includes an interior surface 107. A pair of opposing probe guides 118 are located on interior surface 107. Probe guides 118 are configured to engage a guide slot in an outer surface of the probe cover to facilitate the proper orientation of the probe when it is inserted into receptacle 102. As depicted in FIG. 3, receptacle 102 includes a pair of contact blocks 106 to accommodate a greater number of connections. Other embodiments of the invention may employ a greater or fewer number of contact blocks. A set of contact structures 120 are embedded in each contact block 106. Each contact structure 120 extends into the shaft space 119 defined by housing 104 and is connected to a corresponding wire 108. The set of contact structures 120 are configured in one or more rows that are oriented along a longitudinal axis of housing 104. Contacts 120 may be spring loaded or otherwise enabled to retract from shaft space 119.

When receptacle 102 is secured to an adapter card 123 with a locking nut 124 or other suitable fastening device, a longitudinal axis (an axis perpendicular to first face 105) of housing 104 is perpendicular to the plane defined by adapter card 123 (i.e., the plane in which adapter card 123 lies). In this manner, the footprint of receptacle 102 on adapter card 123 is defined by the cross sectional area of housing 104 and is substantially independent of the number of contacts structures 120. Additional contact structures 120 are accommodated by increasing the number of contact blocks 106, extending the length of housing 104, decreasing the minimum separation between adjacent contacts, or a combination of both.

Figure 4:
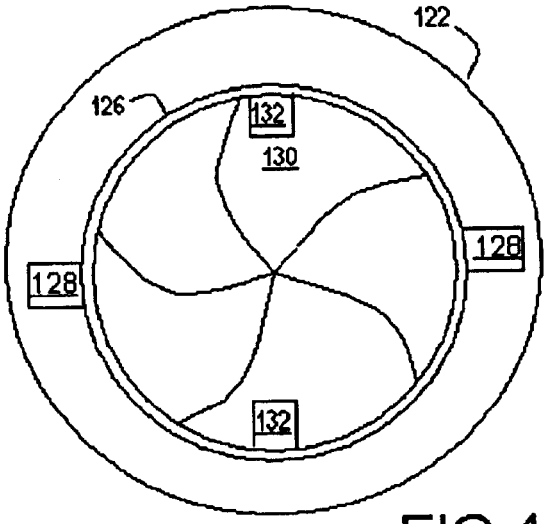
FIG. 4 is a plan view of an iris mechanism suitable for use in the probe receptacle of FIG. 1 with the iris in the closed position.
Figure 5:
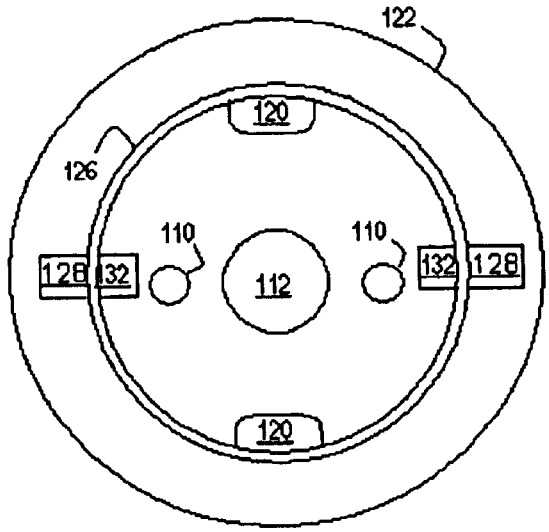
FIG. 5 is a plan view of an iris mechanism suitable for use in the probe receptacle of FIG. 1 with the iris in the open position.

The depicted embodiment of receptacle 102 includes an iris mechanism 122 that provides a cover for housing 104 when the probe is not inserted. Referring also to FIG. 4 and FIG. 5, the iris mechanism 122 includes a multi-piece shutter 130 and a pair of shutter tabs 132. The shutter tabs 132 are configured to be engaged by notched elements of the probe. When the probe notched elements engage shutter tabs 132 and the probe is turned a quarter-turn, the shutter 130 transitions from a closed position depicted in FIG. 4 to a retracted (open) position depicted in FIG. 5. The iris mechanism 122 beneficially provides a housing cover that does not require any significant clearance.

Figure 6:
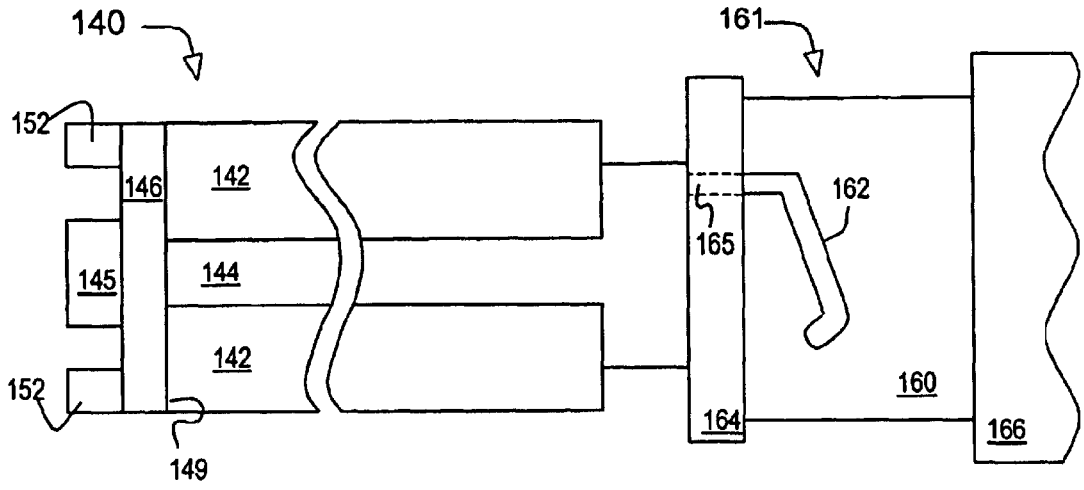
FIG. 6 is a plan view of a probe assembly portion of a connection assembly according to one embodiment of the invention.
Figure 7:
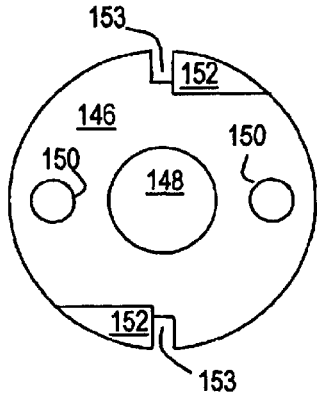
FIG. 7 is a front view of a base plate of the probe assembly of FIG. 6.
Figure 9:
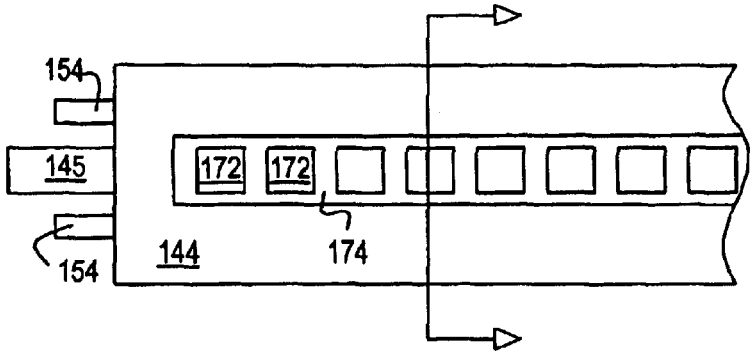
FIG. 9 is a plan view of a probe body portion of the probe assembly of FIG. 6.

Referring to FIG. 6, an embodiment of a probe assembly 140 suitable for use in conjunction with probe receptacle 102 is depicted. The depicted embodiment of probe 140 includes a probe cover 142, a probe body 144, and a probe base plate 146. A front plan view of probe cover base plate 146 is depicted in FIG. 7. Base plate 146 includes a pair of tab elements 152 that are configured to engage the iris tabs 132 (FIG. 4) of iris mechanism 122 when the probe 140 is inserted into receptacle 102. Base plate 146 defines a center aperture or hole 148 and a pair of pin holes 150. Referring also to the top plan view of probe body 144 depicted in FIG. 9, base plate center hole 148 is positioned and sized to receive an extension 145 of probe body 144 while the base plate pin holes 150 are configured to receive retractable or spring loaded pins 154 of probe body 144. When probe assembly 140 is inserted into receptacle 102, the spring loaded pins 154 are engaged and retracted by the receptacle guide pins 110 (FIG. 2) thereby enabling the probe body to pivot relative to probe cover 142 and base plate 146. A pair of base plate guide notches 153 adjacent to either tab 152 are configured to align with and engage probe guides 118 when base plate 146 is fully turned.

Figure 8:
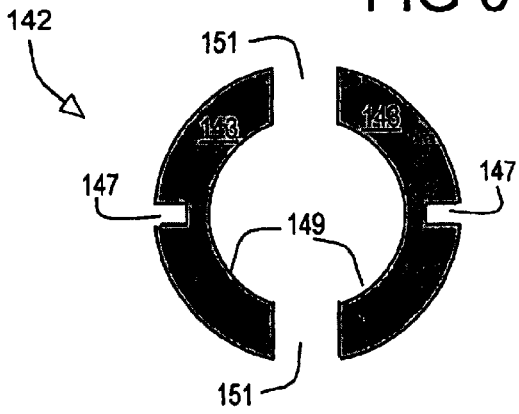
FIG. 8 is a cross sectional view of a probe cover of the probe assembly of FIG. 6.

Referring to FIG. 8, a cross sectional view of probe cover 142 is depicted. Probe cover 142 includes a pair of c-shaped elements 143. The interior surfaces 149 of elements 143 define a circle having a diameter approximately equal to the diameter of probe body 144. The exterior surfaces of probe cover elements 143 define a pair of guide notches 147 that extend the length of probe cover 142. Guide notches 147 are configured to align with base plate guide notches 153 to be engaged by the probe guides 118 (FIG. 3) of receptacle 102 when probe 140 is properly inserted. The probe guides facilitate the proper orientation of probe 140 and receptacle 102 and prevent probe cover 142 from rotating relative to receptacle 102 when probe body 144 is rotated.

Figure 10:
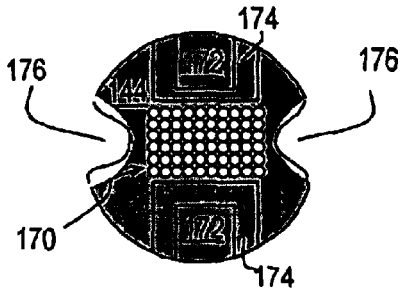
FIG. 10 is a cross sectional view of the probe body of FIG. 9.

Referring also to FIG. 10, a cross section of probe body 144 is depicted. Probe body 144 includes a plurality of insulated and conductive interconnects 170 that extend through the probe body interior. Each interconnect 170 is connected to one of the conductive contact elements 172. Contact elements 172 are preferably arranged in two rows that extend along the longitudinal axis of probe body 144 at 180° from one another. Contact elements 172 are embedded within an electrically insulating field 174 to isolate the various signals from one another. Probe body 144 as depicted in FIG. 10 includes a pair of notches 176 extending the length of probe body 144. Notches 176 are configured to mate with receptacle contracts 120 thereby allowing probe body 144 to be inserted into receptacle 102 without deforming contacts 120. This action prevents electrical contact between contacts 120 and contact elements 172 while probe body 144 is being inserted into the receptacle. When probe body 144 is fully inserted into receptacle 102, probe body 144 may then be turned. The curvature of notches 176 facilitates the compression of spring loaded contacts 120 as probe body 144 is then turned until the contact elements 172 align with contacts 120. The spring loaded contacts 120 are then forced into electrical contact with corresponding contact elements 172.

When probe assembly 140 is removed from receptacle 102, the probe body 144 occupies a first position relative to probe cover 142. In this first position, the row of contact elements 172 are covered by the elements 143 of probe cover 142. Upon insertion of probe assembly 140 into receptacle 102, however, the probe pins 154 are retracted and probe body 144 may pivot or rotate to a second position with respect to probe cover 142. When probe body 144 is rotated to the second position, the contact elements 172 are aligned with gaps 151 (FIG. 8) in probe cover 142, which are in turn aligned with the contact structures 120 in receptacle 102. In this manner, an electrical contact is made between a contact element 172 of probe body 144 and a corresponding contact structure 120 of receptacle 102 when probe assembly 140 is received within receptacle 102 and probe body 144 is rotated from an initial position in which the contact elements 172 are covered to a second position.

In the depicted embodiment, probe body 144 includes two rows of contact elements 172 and receptacle 102 includes two rows of contact structures 120. In this embodiment, the two rows are preferably located at either end of a diameter of probe body 144 (i.e., the two rows are spaced at 180° from one another. In this embodiment the gaps 151 in probe cover 142 are spaced at 180° and probe body 144 is rotated by 90° to go from the first position in which contact elements 172 are covered to the second position in which they are in contact with corresponding contact structures 120 of receptacle 102. The connection assembly may employ a locking mechanism that maintains probe body 144 in its second position during operation.

Probe assembly 140 as depicted herein includes a mechanism for turning probe body 144 within receptacle 102 and locking probe body 144 in a locked position. The depicted embodiment of assembly 140 uses a BNC-type locking mechanism in which a locking portion 160 of probe 140 defines a channel 162. Channel 162 is configured to receive a locking pin 128 (depicted in FIG. 1) located on an exterior surface of a locking portion 126 of receptacle 102. Channel 162 extends diagonally and traverses a quarter of the circumference of locking portion 160. When the locking pin 128 engages channel 162, further insertion of probe body 144 into receptacle 102 requires rotational motion of probe body 144 relative to receptacle 102 and probe cover 142. The extent of channel 162 permits a quarter turn of probe body 144 before locking pin 128 engages a recessed portion of channel 162. In one embodiment, locking portion 160 comprises a portion of a BNC-type assembly 161 that includes a collar 164 and a handle 166. Collar 164 defines an interior channel 165 that aligns with channel 162 and enables locking pin(s) 128 to engage channel 162. Handle 166 may be scribed or otherwise machined to facilitate handling and gripping.

It will be apparent to those skilled in the art having the benefit of this disclosure that the present invention contemplates a connection assembly capable of connecting a large number of pins within consuming a large footprint on an adapter card. It is understood that the form of the invention shown and described in the detailed description and the drawings are to be taken merely as presently preferred examples. It is intended that the following claims be interpreted broadly to embrace all the variations of the preferred embodiments disclosed.

What is claimed is:

1. A connector assembly suitable for connecting a plurality of signals to a data processing system, comprising:

a receptacle configured to attach to an adapter card of the data processing system wherein a longitudinal axis of a receptacle housing extends perpendicularly to a plane defined by the adapter card, the receptacle including a set of contact structures oriented along an axis parallel to the longitudinal axis;

a probe including a plurality of contact elements wherein the probe is sized to be received within the receptacle and wherein the probe is rotatable within the receptacle from a first position, in which the probe contact elements do not contact the receptacle contact structures to a second position in which the probe contact elements align with the receptacle contacts structures;

wherein the receptacle contact structures are further configured to connect to corresponding signals and the probe contact elements are configured to connect to corresponding interconnects such that the signals are connected to their corresponding interconnects when the probe is received within the receptacle in the second position.

2. The apparatus of claim 1, wherein the receptacle contact structures extend within an interior surface of the receptacle housing and the probe contact elements extend from an exterior surface of the probe.

3. The apparatus of claim 1, the receptacle further includes at least one probe guide extending from an interior surface of the receptacle housing and wherein an exterior surface of the probe defines at least one notch configured to receive the probe guide when the probe is inserted into the receptacle.

4. The apparatus of claim 1, wherein the receptacle further comprises an iris mechanism configured to transition from a closed position in which the iris covers an interior of the receptacle to a retracted position enabling insertion of the probe into the receptacle interior.

5. The apparatus of claim 4, wherein the iris includes at least one tab arranged to engage a corresponding notched element of the probe and wherein the iris is configured to retract by engaging the probe notched element with the corresponding tab and rotating the probe relative to the receptacle.

6. The apparatus of claim 1, wherein the probe includes a two-pieced probe cover sized to be received within the receptacle and a probe body including the probe contact elements and wherein the probe body is rotatable within the probe cover from the first position in which the probe cover prevents contact to the probe contact elements to the second position in which at least one gap defined by the probe cover pieces is aligned with at least one of the probe contacts thereby enabling the receptacle contact structures to contact the probe contact elements.

7. The apparatus of claim 6, wherein the probe includes a locking portion that defines a channel configured to receive a locking pin positioned on an exterior surface of a locking portion of the receptacle.

8. The apparatus of claim 7, wherein the channel enables a turn of the probe body sufficient to align the probe contact elements with the receptacle contact structures.

9. The apparatus of claim 6, wherein the probe body defines at least one notch configured to mate with the receptacle contact structures.

10. The apparatus of claim 6, wherein each probe contact element is connected to a corresponding interconnect running through an interior of the probe body.

11. An assembly, comprising:

an adapter card suitable for use with a data processing system the adapter card including a connector assembly comprising:

a receptacle configured to attach to the adapter card of the data processing system wherein a longitudinal axis of a receptacle housing extends perpendicularly to a plane defined by the adapter card, the receptacle including a set of contact structures oriented along an axis parallel to the longitudinal axis;

a probe including a plurality of contact elements arranged to align with the receptacle contacts structures when the probe is received within the receptacle;

wherein the receptacle contact structures are further configured to connect to corresponding signals and the probe contact elements are configured to connect to corresponding interconnects such that the signals are connected to their corresponding interconnects when the probe is received within the receptacle.

12. The system of claim 11, wherein the receptacle contact structures extend within an interior surface of the receptacle housing and the probe contact elements extend from an exterior surface of the probe.

13. The system of claim 11, the receptacle further includes at least one probe guide extending from an interior surface of the receptacle housing and wherein an exterior surface of the probe defines at least one notch configured to receive the probe guide when the probe is inserted into the receptacle.

14. The system of claim 11, wherein the receptacle further comprises an iris configured to transition from a closed position in which the iris covers an interior of the receptacle to a retracted position enabling insertion of the probe into the receptacle interior.

15. The system of claim 14, wherein the iris includes at least one tab arranged to engage a corresponding notched element of the probe and wherein the iris is configured to retract by engaging the probe notched element with the corresponding tab and rotating the probe relative to the receptacle.

16. The system of claim 1, wherein the probe includes a two-pieced probe cover sized to be received within the receptacle and a probe body including the probe contact elements and wherein the probe body is rotatable within the probe cover from a first position in which the probe cover prevents contact to the probe contact elements to a second position in which at least one gap defined by the probe cover pieces is aligned with at least one of the probe contacts thereby enabling the receptacle contact structures to contact the probe contact elements.

17. The system of claim 16, wherein the probe includes a locking portion that defines a channel configured to receive a locking pin positioned on an exterior surface of a locking portion of the receptacle.

18. The system of claim 17, wherein the channel enables a turn of the probe body sufficient to align the probe contact elements with the receptacle contact structures.

19. The system of claim 16, wherein the probe body defines at least one notch configured to mate with the receptacle contact structure.

20. The system of claim 16, wherein each probe contact element is connected to a corresponding interconnect running through an interior of the probe body.

21. A connector assembly for use with a data processing system, comprising:

a cylindrical receptacle attachable to an adapter card such that a longitudinal axis of the receptacle is perpendicular to the adapter card and wherein the receptacle includes a housing having a set of evenly spaced contact structures arranged along an axis that is parallel to the longitudinal axis of the receptacle; and a probe rotatable within the receptacle from a first position to a second position, wherein a line of contact elements along an outer surface of the probe contacts the receptacle contact structures when the probe is the second position and further wherein the line of contact elements do not contact the receptacle structure when the probe is in the first position.

22. The assembly of claim 21, wherein the receptacle contact structures extend within an interior surface of the receptacle housing and the probe contact elements extend from an exterior surface of the probe.

23. The assembly of claim 21, the receptacle further includes at least one probe guide extending from an interior surface of the receptacle housing and wherein an exterior surface of the probe defines at least one notch configured to receive the probe guide when the probe is inserted into the receptacle, wherein the probe guide prevents the probe from attaining the second position until the probe is fully inserted into the receptacle.

24. The assembly of claim 21, wherein the receptacle further comprises an iris configured to transition from a closed position in which the iris covers an interior of the receptacle to a retracted position enabling insertion of the probe into the receptacle interior.

25. The assembly of claim 24, wherein the iris includes at least one tab arranged to engage a corresponding notched element of the probe and wherein the iris is configured to retract by engaging the probe notched element with the corresponding tab and rotating the probe relative to the receptacle.

26. The assembly of claim 21, wherein the probe includes a two-pieced probe cover sized to be received within the receptacle and a probe body including the probe contact elements and wherein the probe body is rotatable within the probe cover from a first position in which the probe cover prevents contact to the probe contact elements to a second position in which at least one gap defined by the probe cover pieces is aligned with at least one of the probe contacts thereby enabling the receptacle contact structures to contact the probe contact elements.

27. The assembly of claim 26, wherein the probe includes a locking portion that defines a channel configured to receive a locking pin positioned on an exterior surface of a locking portion of the receptacle.

28. The assembly of claim 27, wherein the channel enables a turn of the probe body sufficient to align the probe contact elements with the receptacle contact structures.

29. The assembly of claim 26, wherein the probe body defines at least one notch configured to mate with the receptacle contact structures.

30. The assembly of claim 26, wherein each probe contact element is connected to a corresponding interconnect running through an interior of the probe body.

* * * * *